US005192974A

United States Patent [19]

Ikegawa et al.

[11] Patent Number: 5,192,974

[45] Date of Patent: Mar. 9, 1993

[54] CONTRACT CHARGER

[75] Inventors: Akihito Ikegawa, Sakai; Masaki Asano, Amagasaki; Shuji Iino, Hirakata; Izumi Osawa, Ikeda, all of Japan

[73] Assignee: Minolta Camera Kabushiki Kaisha, Osaka, Japan

[21] Appl. No.: 827,337

[22] Filed: Jan. 30, 1992

[30] Foreign Application Priority Data

Feb. 6, 1991 [JP] Japan ..... 3-015461

[51] Int. Cl.[5] ..... G03G 15/02

[52] U.S. Cl. ..... 355/219; 361/225; 361/230

[58] Field of Search ..... 355/219; 361/225, 230, 361/235

[56] References Cited

U.S. PATENT DOCUMENTS 4,851,960 7/1989 Nakamura et al. ..... 361/225
5,060,014 10/1991 Adachi et al. ..... 355/219 X
5,068,762 11/1991 Yoshihara ..... 361/225

FOREIGN PATENT DOCUMENTS 0308185 3/1989 European Pat. Off. ..... 355/219
0439143 7/1991 European Pat. Off. ..... 355/219
0439145 7/1991 European Pat. Off. ..... 355/219
58-158665 9/1983 Japan .
1-93761 4/1989 Japan .
0267667 10/1989 Japan ..... 355/219
1261675 10/1989 Japan ..... 355/219
0282279 11/1990 Japan ..... 355/219

*Primary Examiner*—A. T. Grimley
*Assistant Examiner*—Matthew S. Smith
*Attorney, Agent, or Firm*—Burns, Doane, Swecker & Mathis

[57] ABSTRACT

A contact charger for charging an image bearing member comprises a support member, a flexible film supported at a side end by the support member and having a free end adapted to contact the surface of the image bearing member, and power device for applying charging voltage to the flexible film.

11 Claims, 2 Drawing Sheets

CONTRACT CHARGER

BACKGROUND OF THE INVENTION

1. Field of the Invention

The present invention relates to a contact charger for use in image forming apparatus such as electrophotographic copying machines and printers.

2. Related Art of the Invention

In electrophotographic copying machines, printers and like image forming apparatus, an electrostatic latent image bearing member such as a photosensitive drum is charged by a charger, and the charged area is exposed to light to form thereon an electrostatic latent image, which is then developed to a visible image and thereafter transferred and fixed to a copy sheet.

Various types of chargers are known which are divided generally into those of the noncontact type utilizing corona discharge, and those of the contact type wherein a brush, roller or drivingly revolvable endless belt is held in contact with the surface of the electrostatic latent image bearing member, or wherein a blade made of rigid body is pressed against one point on the surface of the image bearing member and voltage is applied to the blade.

The chargers of the noncontact type utilizing corona discharge have the advantage of effecting stabilized charging, but possess the problem of producing a large amount of ozone which deteriorates the image bearing member and exerts an adverse influence on the human body. Attention is therefore directed to the chargers of the contact type which are much smaller than the corona chargers in the amount of ozone produced.

Among the chargers of the contact type, however, those employing the brush have the problem that the production of the brush requires labor, while those wherein the roller or endless belt is used need means for driving the roller or belt, and are therefore correspondingly more complex in construction. Moreover, the roller remains in contact with the image bearing member even while the image forming apparatus is out of operation, is accordingly subjected to residual strain due to creep and consequently fails to effect proper charging. Furthermore, the charger having the endless belt has the problem of being large-sized in its entirety and necessitating a complex belt drive system. The charger having the blade encounters difficulty in setting the blade in position because the blade, which is a rigid body, is not smoothly in contact with the the surface of the image bearing member, and has the likelihood of defacing the image bearing member since the blade is held in contact with the image bearing member surface under high pressure. Because of the high pressure, the electrostatic latent image bearing member further needs a great torque for rotation.

SUMMARY OF THE INVENTION

The problem that the charger requires much labor when it is to be made, is complex in construction or large-sized, or needs a complex drive system is not negligible in providing image forming apparatus of reduced cost and smaller size as presently required.

Accordingly, an object of the present invention is to provide a charger of the contact type which is simpler in construction and can be made available correspondingly more easily at a lower cost than the conventional ones, and which nevertheless has high reliability and is operable in a stabilized state to effect satisfactory charging.

To fulfill the above object, the present invention provides a contact charger which comprises a flexible charging film supported at a side end portion and having a free end portion adapted to contact an electrostatic latent image bearing member, a charging voltage being applicable to the flexible film.

With reference to FIG. 3, useful as the flexible film of the present invention is a thin material S which is $M \leqq 20$ (g.cm), preferably $M \leqq 10$ (g.cm), in the bending moment M required when the material S has a width b of 1 cm and is bent around a core rod A having a circular cross section and an outside diameter D of 1 cm.

The bending moment M is a value calculated from $M = EI/\rho$ wherein E is Young's modulus ($g/cm^2$) of the film, I is the second moment of area ($cm^4$) of the film and is given by $I = bh^3/12$ (where h is the thickness (cm) of the film), and $\rho$ is the radius (cm) of curvature of the film, i.e., the distance from the center of curvature, which is the center 0 of the core rod A, to the neutral surface NS of the film.

When exceeding 20 (g.cm) in the bending moment M, the material fails to satisfactorily contact the surface of the electrostatic latent image bearing member. Stated more specifically, it is then difficult for the material to contact the surface of the image bearing member over a suitable nip width. Such a nip width is preferably about 2 to about 8 mm. When the material is not suitable in the nip width, the image bearing member surface is prone to have potential irregularities, consequently permitting occurrence of image noise undesirably.

The lower limit value of the bending moment M, although not limited specifically, is preferably at least about 0.001 (g.cm) for the different reason that the film needs to retain mechanical strength (against breaking or rupture) for use in contact charging.

BRIEF DESCRIPTION OF THE DRAWINGS

The above and other objects or features of the present invention will become apparent from the following description of preferred embodiments thereof taken in conjunction with the accompanying drawings, in which.

In the following description, like parts are designated by like reference numbers throughout the several drawings.

DESCRIPTION OF THE PREFERRED EMBODIMENTS

Embodiments of the invention will be described below with reference to the drawings.

The embodiments to be described below are all adapted for use in printers of the construction schematically shown in FIG. 1. The printer shown in FIG. 1 will be described first.

Figure 1:
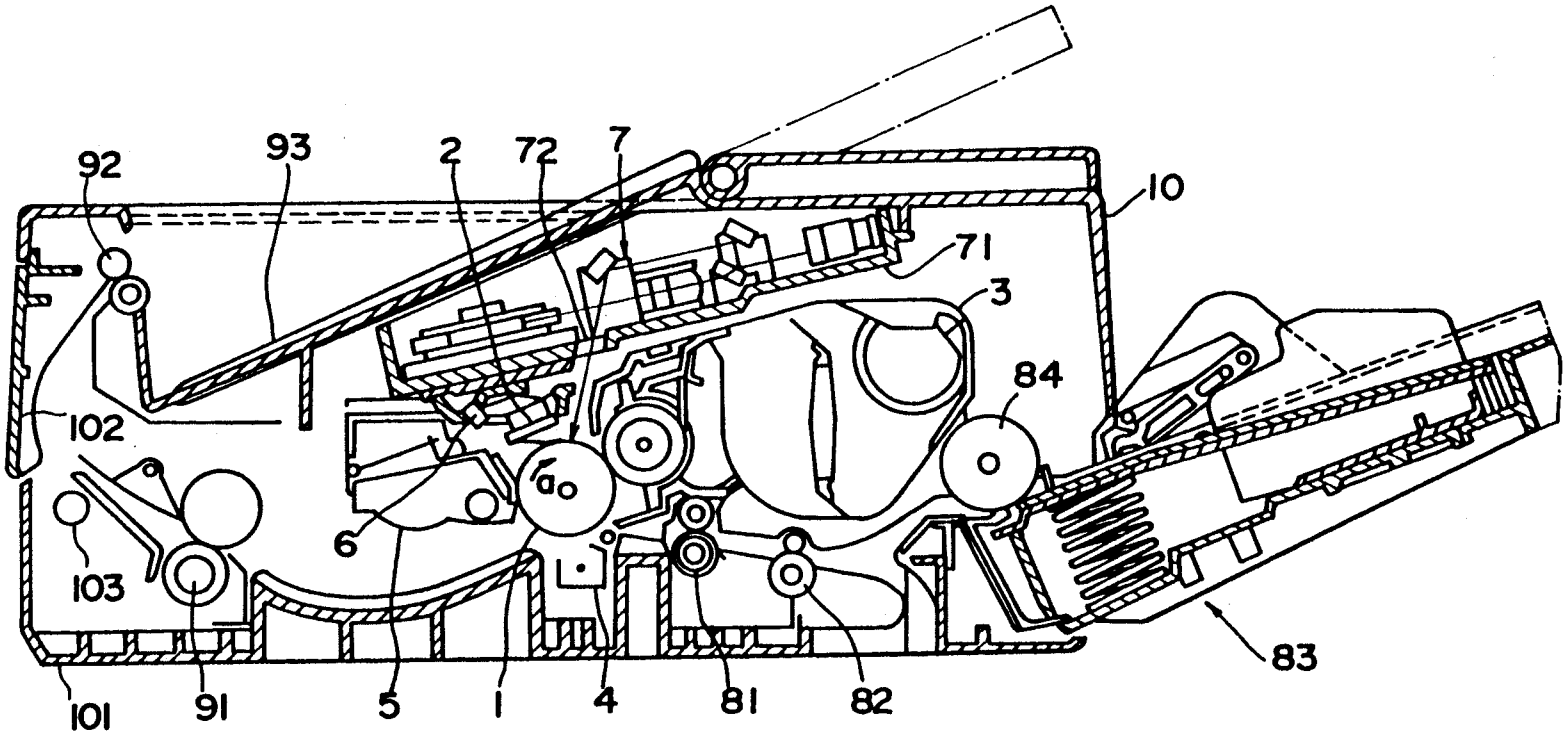
FIG. 1 is a diagram showing an example of printer having incorporated therein a charger of the invention.

The printer of FIG. 1 centrally has a photosensitive drum 1 serving as an electrostatic latent image bearing member. The drum is drivingly rotated in the direction of arrow a by unillustrated drive means. Successively arranged around the drum 1 are a charger 2, developing unit 3, transfer charger 4, cleaner 5 and eraser 6. The charger 2 is a device embodying the present invention.

Disposed above the photosensitive drum 1 is an optical system 7, which comprises as arranged in a housing 71 a semiconductor laser, polygonal mirror, toroidal lens, half mirror, spherical mirror, reflecting mirrors, etc. The housing 71 has a bottom wall which is formed with an exposure slit 72. The drum 1 can be exposed to image forming light which is passed through the slit 72 and the space between the charger 2 and the developing unit 3 and projected on the drum 1. Arranged at the right side of the drum 1 in the drawing are a pair of timing rollers 81, pair of intermediate rollers 82 and paper cassette 83. A paper feed roller 84 is opposed to the cassette 83. A pair of fixing rollers 91 and pair of discharge rollers 92 are arranged at the left side of the drum 1 shown. A discharge tray 93 is provided adjacent to the discharge rollers 92.

With this printer, the surface of the drum 1 is uniformly charged to a predetermined potential by the charger 2, and the charged area is exposed to the light from the optical system 7, whereby an electrostatic latent image is formed. The latent image is developed to a toner image by the developing unit 3 and then transported to a transfer station opposed to the transfer charger 4.

On the other hand, copy paper is withdrawn from the paper cassette 83 by the feed roller 84, passed between the intermediate rollers 82 and brought to the pair of timing rollers 81, which feeds the paper to the transfer station as timed with the toner image on the drum 1. Thus, the transfer charger 4 at the transfer station acts to transfer the toner image from the drum 1 onto the copy paper. The copy paper is brought to the pair of fixing rollers 91, which fixes the toner image to the paper. The paper is thereafter delivered to the tray 93 by the discharge rollers 92.

The toner remaining on the drum 1 after the toner image has been transferred to the paper is removed by the cleaner 5, and residual toner is removed by the eraser 6.

The system speed of the printer (peripheral speed of the drum 1) is 3.5 cm/sec, and the developing unit 3 is of the contact type for use with a single toner and effects reversal development.

The photosensitive drum 1 of the present printer is prepared by the following method and is a function-separated organic photosensitive member having sensitivity to the light of long wavelengths and to be charged negatively.

Stated specifically, the photosensitive drum 1 is prepared by dipping a hollow cylindrical aluminum substrate in a coating composition obtained by dissolving tau-type metal-free phthalocyanine and polyvinyl butyral resin in an organic solvent, drying the coating to form a charge generating layer of 0.4 μm in thickness, coating the layer with a solution of a hydrazone compound and polycarbonate resin in an organic solvent by dipping, and drying the coating to form a charge transport layer having a thickness of 18 μm.

Incidentally, conventional electrostatic latent image bearing members are usable with the charger of the present invention without any limitation.

The photosensitive drum is not in any way limited with respect to the materials but can be an organic photosensitive member of the function-separated type described or an organic photosensitive member of single-layer construction. Furthermore, the charge generating material, charge transport material, binder resin, etc. can be any of those already known. Useful materials are not limited to those of the organic type; also usable are inorganic materials such as zinc oxide, cadmium sulfide, selenium alloys and amorphous silicon.

It is desirable to form a surface protective layer over the outermost surface of the photosensitive member. Useful materials for the layer are resins such as ultraviolet-curing resins, thermosetting resins and those curable at room temperature. Also usable are such resins having a resistivity-adjusting substance dispersed therein, thin films of metal oxide, metal sulfide or the like which are formed in a vacuum as by vacuum evaporation or ion plating, and amorphous carbon films prepared from hydrocarbon gases by plasma polymerization.

The toner for use in the developing unit 3 is of the negatively chargeable type, prepared from polyester resin by kneading and pulverization and 10 μm in mean particle size, and comprises 80 wt. % of particles ranging from 7 to 13 μm in particle size. The particulate toner has admixed therewith by stirring 0.75 wt. % of hydrophobic silica ( Tanolax product of Tarco Co. Ltd. ) as a fluidizing agent.

The toner is accommodated in the developing unit 3 and is used for reversal development at developing bias of −300 V.

Figure 2:
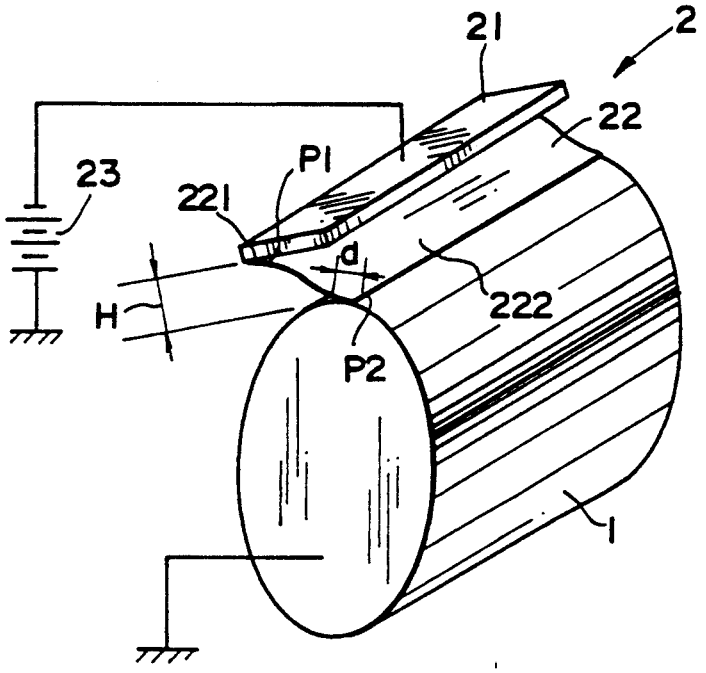
FIG. 2 is a perspective view showing the basic construction of the charger of the invention.

Next, the basic construction of the charger 2 for use in the printer will be described with reference to FIG. 2. As shown in FIG. 2, the charger 2 comprises an electrically conductive support plate 21 (made of aluminum in the present embodiment), and a flexible charging film 22 supported at a side end portion 221 by the support plate 21 and having a free end portion 222 which extends from an end Pl of the supported portion to a film free end P2 and is at least partly in contact with the photosensitive drum 1. The support plate 21 is spaced apart from the surface of the drum 1 by a distance H of 5 mm and extends widthwise of the drum 1. Similarly, the flexible film 22 also extends widthwise of the drum 1. The length of the flexible film 22 from the end P1 of its supported portion to the film free end P2 is preferably 10 to 30 mm. The support plate 21 has connected thereto a power source 23 for applying the charging negative voltage.

With the charger of the present invention, the portion 222 of the flexible film 22 to which the charging voltage is applied, i.e., the portion extending from the end P1 of its supported portion 221 to the film free end P2, is entirely or partly in contact with the surface of the electrostatic latent image bearing member to charge the surface to a predetermined potential.

The film 22 is thus in contact with the photosensitive drum 1 over a nip width d, which refers to the film region having approximately the same curvature as the drum 1 for contact therewith as shown in FIG. 2. The film 22 can contact the drum 1 along the curvature thereof in this way because the bending moment M of the film 22 is made not greater than the above-specified value. Preferably, the nip width d is altered in accordance with the material of the film 22 and the voltage to be applied. From the viewpoint of uniform charging and image noise, it is desirable that the nip width d be set to about 2 to about 8 mm.

Figure 3:
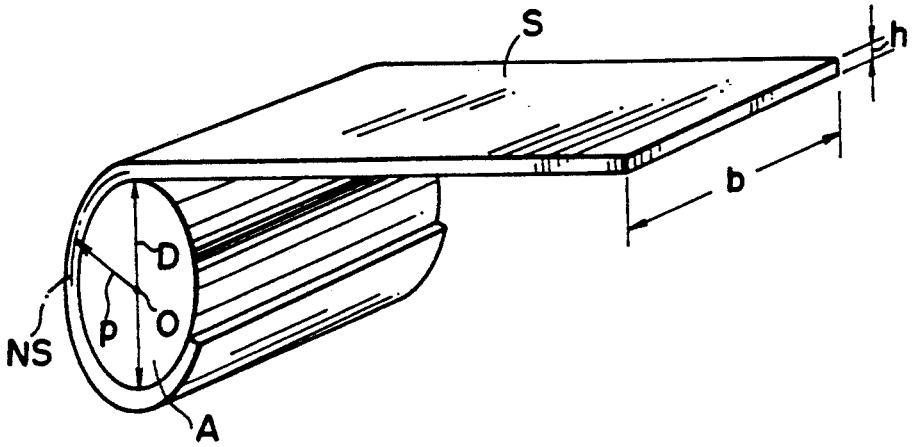
FIG. 3 is a diagram illustrating a charging film.

As already described with reference to FIG. 3, it is desired that the flexible film 22 embodying the invention have the characteristics of $M \leqq 20$ (g.cm), preferably $M \leqq 10$ (g.cm), in terms of the bending moment M required when the film has a width b of 1 cm and is bent around a core rod A having a circular cross section and an outside diameter D of 1 cm.

The bending moment M is a value calculated from $M=EI/\rho$ wherein E is Young's modulus ($g/cm^2$) of the film, I is the second moment of area ($cm^4$) of the film and is given by $I=bh^3/12$ (where h is the thickness (cm) of the film), and $\rho$ is the radius (cm) of curvature of the film, i.e., the distance from the center of curvature, which is the center O of the core rod A, to the neutral surface NS of the film.

When exceeding 20 (g.cm) in the bending moment M, the film fails to satisfactorily contact the surface of the electrostatic latent image bearing member, producing marked potential irregularities on the image bearing member surface and permitting occurrence of great image noise undesirably.

The lower limit value of the bending moment M, although not limited specifically, is preferably at least about 0.001 (g.cm) for the different reason that the film needs to retain mechanical strength (against breaking or rupture) for use in contact charging.

It is desirable to set the bending moment M of the flexible film 22 to the above range also for the film to fit to the surface of the drum 1 over a suitable nip width.

For use in charging the drum, the flexible film 22 preferably has electric conductivity or low electric resistivity (preferably $10^3$ to $10^8$ ohm-cm).

Examples of useful materials for the film 22 are as follows. Metal materials Aluminum, gold, copper, iron, silver, chromium, nickel, platinum, tin, titanium and like metals, or alloys of such metals. Synthetic resin materials suitably rendered electrically conductive or made to have low resistivity by incorporating an electrically conductive material into synthetic resins or subjecting the surface of synthetic resins to a conductivity-imparting treatment. Suitable resins for these materials are given below.

Polyethylene, polypropylene and like polyolefin resins,
polyvinyl alcohol, polyvinyl acetate and like polyacetal resins,
ethylene-vinyl acetate copolymer,
polymethyl methacrylate, acrylonitrile-methyl acrylate copolymer and like acrylic resins,
polycarbonate, polystyrene, acrylonitrile-butadiene-styrene copolymer, polyethylene terephthalate, polyurethane elastomer,
viscose rayon, cellulose nitrate, cellulose acetate, cellulose triacetate, cellulose propionate, cellulose acetate butyrate, ethylcellulose, regenerated cellulose and like cellulose resins,
nylon 6, nylon 66, nylon 11, nylon 12, nylon 46 and like polyamide resins,
polyimide, polysulfone, polyether sulfone,
polyvinyl chloride, vinyl chloride-vinyl acetate copolymer, polyvinylidene chloride, vinylidene chloride-vinyl chloride copolymer, polytetrafluoroethylene, polychlorofluoroethylene, polyvinyl fluoride, polyvinylidene fluoride and like polyvinyl halide resins,
vinylnitrile rubber alloy, etc.

Especially when a metal powder, metal whisker, carbon black, carbon fiber or the like is incorporated into such a resin, the resin can be given low resistivity of about $10^3$ to about $10^8$ ohm-cm even if it is not made conductive.

The flexible film 22 is prepared from the above-mentioned metal material or synthetic resin material so as to have the foregoing value in bending moment M. If the film 22 is adjusted to a thickness of about 5 to about 100 μm when made of the metal material or to a thickness of about 100 to about 300 μm when made of the synthetic resin, it is easy to set the bending moment M to the specified value.

The flexible film 22 will deface the photosensitive drum 1 when having an excessively high hardness. Accordingly, the drum 1 may be provided with a surface protective layer like those already mentioned, while it is desired that the film 22 itself be up to 100 in Vickers hardness. The lower limit of the Vickers hardness, although not limitative specifically, is preferably at least about 10 in view of the strength.

The charging voltage to be applied to the charging flexible film 22 can be d.c. or a.c. voltage, or superposed voltage of these currents.

It is generally desirable to use a d.c. component of about 700 to about 1500 (V) in absolute value, and an a.c. component with a peak-to-peak component of about 300 to about 1000 (V) in absolute value and a frequency of about 50 Hz to about 1 KHz.

When the a.c. component is superposed on the d.c. component, an improved charging efficiency is attained to result in an increased amount of charges and produce images with diminished irregularities. Further if d.c. only is used, the film 22 tends to become electrostatically attracted to the surface of the drum 1 with an increase in the rotational torque, whereas the superposition of the a.c. component attenuates such electrostatic attraction to preclude the increase in the rotational torque.

Examples and comparative examples will be described below in which flexible films 22 of different materials and varying values of bending moment M were used.

EXAMPLES 1-5 AND COMPARATIVE EXAMPLES 1-3

As flexible charging films 22, aluminum films were used which had Young's modulus (E) of $7.0\times10^8$ ($g/cm^2$) and varying thicknesses as listed in Table 1 to prepare Examples 1 to 5 of chargers of the construction described above. Aluminum sheets having the same Young's modulus as above and a thickness of 100 μm, 70 μm or 60 μm were also used for the charger 2 in place of the film 22 to prepare Comparative Examples 1 to 3. Each of these examples was incorporated into the same printer as already described, and the surface of the photosensitive drum 1 was charged by applying a charging voltage of −1.1 KV to the aluminum film or sheet. The charge irregularities on the surface of the drum 1 and the resulting image noise were then checked with the result given in Table 1. In all of the present examples, the distance between the supported end Pl and the free end P2 was 15 mm.

In Table 1, ΔVo stands for the range of variations in the surface potential of the photosensitive drum in the longitudinal direction of the drum. The result was evaluated according to the following criteria A to D.

---

$\Delta Vo \leqq 150$ V
Stable surface potential with no image noise due to the influence of ΔVO.
Evaluation symbol: A $150 V < \Delta Vo \leqq 250$ V
Slightly unstable surface potential, resulting in image noise due to the influence of ΔVO but no problem in actual use.
Evaluation symbol: B $250 V < \Delta Vo \leqq 350$ V
Irregularities in surface potential produced image noise undesirable for use.

-continued

| | |
|---|---|
| | Evaluation symbol: C |
| 350 V < ΔVo | |
| Unacceptable for use. | |
| | Evaluation symbol: D |

In Table 1, the column of charge irregularities (ΔVo), the values in the parentheses are the medians of drum surface potentials ($V_0$) as expressed in volts.

In Table 1, the column of image noise, the evaluation symbols O, Δ and X represent the following.

○: No image noise recognized.

Δ: Image noise recognized but permissible for use.

X: Image noise undesirable for use.

TABLE 1

| | Thickness of film or sheet (μm) | Second moment of area ($cm^4$) | Bending moment M (g · cm) | Charge irregularities (ΔVo) | Image noise |
|---|---|---|---|---|---|
| Ex. 1 | 55 | $1.39 \times 10^{-9}$ | 19.3 | B (−750) | Δ |
| Ex. 2 | 50 | $1.04 \times 10^{-9}$ | 14.5 | B (−750) | Δ |
| Ex. 3 | 45 | $7.59 \times 10^{-9}$ | 10.6 | B (−760) | Δ |
| Ex. 4 | 40 | $5.33 \times 10^{-9}$ | 7.44 | A (−770) | ○ |
| Ex. 5 | 30 | $2.25 \times 10^{-9}$ | 3.14 | A (−770) | ○ |
| Comp. Ex. 1 | 100 | $8.33 \times 10^{-8}$ | 115.0 | C (−710) | X |
| Comp. Ex. 2 | 70 | $2.86 \times 10^{-8}$ | 39.7 | C (−730) | X |
| Comp. Ex. 3 | 60 | $1.80 \times 10^{-8}$ | 25.0 | C (−730) | X |

Table 1 reveals that the aluminum films or sheets used, even if different in thickness, readily afforded a stabilized surface potential of about −710 to about −770 (V). The table further indicates that the films of Examples 1 to 5, having the specified thickness and up to 20 (g.cm) in bending moment M as already stated, were usable free of problems as to charge irregularities and image noise. It is also seen that the films up to 10 (g.cm) in bending moment M exhibited very satisfactory properties.

EXAMPLES 6-8 AND COMPARATIVE EXAMPLES 4 AND 5

As flexible charging films 22, polyethylene films were used which were $7.4 \times 10^6$ (g/cm$^2$) in Young's modulus, had electrically conductive carbon powder dispersed therein and were different in thickness as listed in Table 2 to prepare Examples 6 to 8 of chargers. The polyethylene films contained the carbon powder in an amount of about 15 wt. % based on the whole weight of the film and were $10^3$ ohm-cm in electric resistivity.

On the other hand, Comparative Examples 4 and 5 were prepared using polyethylene sheets having a thickness of 400 μm or 300 μm and having the same Young's modulus and resistivity as the above films for the charger 2 in place of the film 22.

Each of these examples was incorporated into the same printer as above, and the surface of the photosensitive drum 1 was charged by applying a charging voltage of −1.1 KV to the film or sheet. The charge irregularities on the surface of the drum 1 and the resulting image noise were then checked with the result given in Table 2. In Table 2, the column of charge irregularities, the values in the parentheses are the medians of drum surface potentials as expressed in volts.

TABLE 2

| | Thickness of film or sheet (μm) | Second moment of area ($cm^4$) | Bending moment M (g · cm) | Charge irregularities (ΔVo) | Image noise |
|---|---|---|---|---|---|
| Ex. 6 | 250 | $1.30 \times 10^{-6}$ | 18.8 | B (−750) | Δ |
| Ex. 7 | 200 | $6.67 \times 10^{-7}$ | 9.67 | A (−760) | ○ |
| Ex. 8 | 150 | $2.81 \times 10^{-7}$ | 4.10 | A (−760) | ○ |
| Comp. Ex. 4 | 400 | $5.33 \times 10^{-6}$ | 75.9 | C (−720) | X |
| Comp. Ex. 5 | 300 | $2.25 \times 10^{-6}$ | 32.3 | C (−740) | X |

Table 2 reveals that the polyethylene films or sheets having the conductive carbon powder dispersed therein readily afforded a stabilized surface potential of about −720 to about −760 (V) although different in thickness.

The films of Examples 6 to 8, having the specified thickness and up to 20 (g.cm) in bending moment M, were usable free of problems as to charge irregularities and image noise. It is also seen that the films up to 10 (g.cm) in bending moment M exhibited very satisfactory properties.

EXAMPLES 9-13 AND COMPARATIVE EXAMPLE 6

As flexible charging films 22, polyethylene films were $1.12 \times 10^7$ (g/cm$^2$) in Young's modulus, had electrically conductive carbon powder dispersed therein and were different in thickness as listed in Table 3 to prepare Examples 9 to 13 of chargers. The polyethylene films contained the carbon powder in an amount of about 5 wt. % based on the whole weight of the film and were $10^8$ ohm-cm in electric resistivity.

On the other hand, Comparative Example 6 was prepared using a polyethylene sheet having a thickness of 240 m and having the same Young's modulus and resistivity as the above films for the charger 2 in place of the film 22.

Each of these examples was incorporated into the same printer as above, and the surface of the photosensitive drum 1 was charged by applying a charging voltage of −1.1 KV to the film or sheet. The charge irregularities on the surface of the drum 1 and the resulting image noise were then checked with the result given in Table 3. In Table 3, the column of charge irregularities, the values in the parentheses are the medians of drum surface potentials as expressed in volts.

TABLE 3

| | Thickness of film or sheet (μm) | Second moment of area ($cm^4$) | Bending moment M (g · cm) | Charge irregularities (ΔVo) | Image noise |
|---|---|---|---|---|---|
| Ex. 9 | 220 | $8.87 \times 10^{-7}$ | 19.4 | B (−720) | Δ |
| Ex. 10 | 200 | $6.67 \times 10^{-7}$ | 14.6 | B (−720) | Δ |
| Ex. 11 | 180 | $4.86 \times 10^{-7}$ | 10.7 | B (−750) | Δ |
| Ex. 12 | 160 | $3.41 \times 10^{-7}$ | 7.53 | A (−760) | ○ |
| Ex. 13 | 140 | $2.29 \times 10^{-7}$ | 5.05 | A (−760) | ○ |

TABLE 3-continued

| | Thickness of film or sheet (μm) | Second moment of area ($cm^4$) | Bending moment M (g · cm) | Charge irregularities (ΔVo) | Image noise |
|---|---|---|---|---|---|
| Comp. Ex. 6 | 240 | $1.15 \times 10^{-6}$ | 25.2 | C (−700) | X |

Table 3 reveals that the polyethylene films or sheet having the conductive carbon powder dispersed therein readily afforded a stabilized surface potential of about −700 to about −760 (V) although different in thickness.

The films of Examples 9 to 13, having the specified thickness and up to 20 (g.cm) in bending moment M, were usable free of problems as to charge irregularities and image noise. It is also seen that the films up to 10 (g.cm) in bending moment M exhibited very satisfactory properties.

EXAMPLES 14–16

The photosensitive layer of the drum 1 was partly removed with THF solvent to make substrate exposed portions (pinholes) having a diameter of about 3 mm. Examples 14, 15 and 16 were then prepared which included the same film as Examples 4, 7 and 13, respectively. Each of these examples was incorporated into a printer of the same type as above for use with the photosensitive drum 1 having the pinholes, and the drum surface was charged with a charging voltage of −1.1 KV. The charge irregularities on the drum surface and the resulting image noise were checked. Consequently all the examples were found comparable to Examples 4, 7 and 13 in charging properties.

In Example 14, the bias on the drum, i.e., the voltage applied to the film, was occasionally found to directly leak to the drum substrate through the pinhole portion, whereas Examples 15 and 16 were found free of such leakage. This indicates that the film exhibits more preferable charging properties when having an electric resistivity of about $10^3$ to about $10^8$ ohm-cm.

EXAMPLES 17–19

Examples 17, 18 and 19 were prepared which included the same film as Examples 3, 6 and 12, respectively. Each of these examples was incorporated into a printer of the same construction as above, and the surface of the drum 1 was charged. In these Examples 17 to 19, the voltage applied to the film was d.c. −800 (V) and a.c. 300 (V) (peak-to-peak voltage of 600 V) as superposed thereon. Thus, the voltage applied was −1.1 KV in peak value. The result is shown in Table 4, in which the values in the parentheses in the column of charge irregularities are medians of drum surface potential as expressed in volts.

TABLE 4

| | Charge irregularities (ΔVo) | Image noise |
|---|---|---|
| Example 17 | A (−800) | ○ |
| Example 18 | A (−800) | ○ |
| Example 19 | A (−790) | ○ |

Table 4 reveals that these examples are greater than Examples 3, 6 and 12 in the amount of charge and achieve improvements in respect of charge irregularities and image noise, indicating that the charging method with use of a.c. attains better results.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A contact charger for charging an electrostatic latent image bearing member having a surface, comprising:

a support member;

a flexible film supported at a side end portion by the support member and having a free end portion adapted to contact the surface of the electrostatic latent image bearing member, said film having a bending moment M defined by the following formula, $$0.001\ (\text{g.cm}) \leqq M \leqq 20(\text{g.cm}),$$

$$M = EI/\rho$$

wherein E is Young's modulus ($g/cm^2$) of the film, I is the second moment of area ($cm^4$) of the film and $\rho$ is a radius of curvature (cm) of the film when the film is curved; and a power source for applying a charging voltage to the film to charge the surface of the electrostatic latent image bearing member.

2. A contact charger as claimed in claim 1 wherein the end portion of the film is in contact with the surface of the electrostatic latent image bearing member over a nip width of 2 to 8 (mm).

3. A contact charger as claimed in claim 1 wherein the film has electric conductivity of $10^3$ to $10^8$ (ohm-cm).

4. A contact charger as claimed in claim 3 wherein the film is made of metal material and adjusted to a thickness of 5 to 100 (micro-meter).

5. A contact charger as claimed in claim 3 wherein the film is made of resin and electrically conductive fillers dispersed in the resin and is adjusted to a thickness of 100 to 300 (micro-meter).

6. A contact charger as claimed in claim 1 wherein the film has a Vickers hardness of 10 to 100.

7. A contact charger as claimed in claim 1 wherein the power source applies both a direct current voltage and an alternating current voltage to the film.

8. A contact charger as claimed in claim 7 wherein the direct current voltage is 700 to 1500 volts in absolute value and the alternating current voltage is 300 to 1000 volts in absolute value and has a frequency of 50 Hz to 1 KHz.

9. The contact charger of claim 1, wherein:

I is represented by the formula $I = bh^3/12$, wherein b is the width (cm) of the film, h is the thickness (cm) of the film, and said bending moment M is obtain when b = 1 (cm) and $\rho = 0.5$ (cm) are set.

10. A contact charger for charging a rotating recording member having a surface comprising:

a support member fixed at a position adjacent to the rotating recording member;

a flexible film supported at a side end portion by the support member and having a free end portion adapted to be in contact with the surface of the recording member with a predetermined nip width wherein said contacted free end portion is located downstream of the supported side end portion with respect to a rotating direction of the recording member; and means for applying a charging voltage to the flexible film to charge the surface of the recording member;

wherein the film has a bending moment M defined by the following formula:

$$0.001\ (\text{g.cm}) \leqq M \leqq 20\ (\text{g.cm}),$$

$$M = EI/\rho$$

wherein E is Young's modulus ($g/cm^2$) of the film, I is the second moment of area ($cm^4$) of the film, and $\rho$ is a radius of curvature (cm) of the film when the film is curved.

11. A contact charger as claimed in claim 10 wherein the charging voltage applying means applies both a direct current voltage and an alternating current voltage to the film.

12. A contact charger as claimed in claim 11 wherein the direct current voltage is 700 to 1500 volts in absolute value and the alternating current voltage is between 300 to 1000 volts in absolute value and has a frequency of 50 Hz to 1 KHz.

13. The contact charger of claim 10, wherein:

I is represented by the formula $I = bh^3/12$, wherein b is the width (cm) of the film, h is the thickness (cm) of the film, and said bending moment M is obtained when $b = 1$ (cm) and $\rho = 0.5$ (cm) are set.

* * * * *

UNITED STATES PATENT AND TRADEMARK OFFICE

CERTIFICATE OF CORRECTION

PATENT NO. : 5,192,974

DATED : March 9, 1993

INVENTOR(S) : Akihito IKEGAWA ET AL

It is certified that error appears in the above-identified patent and that said Letters Patent is hereby corrected as shown below:

On title page, item [54] and col. 1, line 1, delete "CONTRACT CHARGER" and insert --CONTACT CHARGER--.

Signed and Sealed this

Sixteenth Day of November, 1993

Bruce Lehman

*Attest:*

BRUCE LEHMAN

*Attesting Officer*

*Commissioner of Patents and Trademarks*